US012195901B2

(12) United States Patent
Yao et al.

(10) Patent No.: US 12,195,901 B2
(45) Date of Patent: Jan. 14, 2025

(54) THREAD BODY SEWING STRUCTURE

(71) Applicant: LIGHT TEXTILE INC., Taichung (TW)

(72) Inventors: Ming-Hsien Yao, Taichung (TW); Shun-Tai Yao, Taichung (TW)

(73) Assignee: LIGHT TEXTILE INC., Taichung (TW)

( * ) Notice: Subject to any disclaimer, the term of this patent is extended or adjusted under 35 U.S.C. 154(b) by 118 days.

(21) Appl. No.: 17/836,640

(22) Filed: Jun. 9, 2022

(65) Prior Publication Data

US 2023/0193540 A1 Jun. 22, 2023

(30) Foreign Application Priority Data

Dec. 20, 2021 (TW) ..... 110147654

(51) Int. Cl.
*D05B 93/00* (2006.01)

(52) U.S. Cl.
CPC ..... *D05B 93/00* (2013.01)

(58) Field of Classification Search
CPC . D05B 93/00; D05B 1/08; D05B 1/12; D05B 1/20; D05B 1/22; D05B 1/02; D05B 1/04
See application file for complete search history.

(56) References Cited

U.S. PATENT DOCUMENTS 325,499 A * 9/1885 Chilton ..... D05C 7/08 112/101
875,604 A * 12/1907 Parkes ..... D05B 3/02 112/100
1,855,254 A * 4/1932 Moffatt ..... D05B 53/00 112/100
2,067,340 A * 1/1937 Prazak ..... D05B 35/06 112/100
2,623,485 A * 12/1952 Van Wagener ..... D05B 81/00 112/160
2,686,484 A * 8/1954 Cuthbertson ..... D05B 35/06 242/130

(Continued)

FOREIGN PATENT DOCUMENTS

EP 3252195 A1 12/2017
EP 3875648 A1 9/2021

(Continued)

OTHER PUBLICATIONS

U.S. Appl. No. 17/829,829, Liu, Priority Document.*

(Continued)

*Primary Examiner* — Ismael Izaguirre
(74) *Attorney, Agent, or Firm* — Guice Patents PLLC

(57) ABSTRACT

The invention relates to a thread body sewing structure, comprising: a sheet-shaped object, at least one upper thread, and at least one thread body, the upper thread and the thread body are sewn on the sheet-shaped object, the upper thread is located on a front side of the sheet-shaped object; the thread body is fixed on the front side of the sheet-shaped object by the upper thread. Thereby, the thread body is fixed on the front side of the sheet-shaped object by the upper thread, and does not need to pass through the object, so the thread body will not be damaged, and an integrity of its structure and functions can be maintained.

16 Claims, 14 Drawing Sheets

(56) References Cited

U.S. PATENT DOCUMENTS

| | | | | | |
|---|---|---|---|---|---|
| 2,773,462 | A * | 12/1956 | Seaman | D05B 35/06 | 112/100 |
| 2,824,531 | A * | 2/1958 | Breul | D05B 35/06 | 112/100 |
| 4,640,209 | A * | 2/1987 | Glenn | D05C 7/08 | 112/429 |
| 4,727,603 | A * | 3/1988 | Howard | A41D 27/085 | 2/905 |
| 5,366,780 | A * | 11/1994 | Rapisarda | A41D 27/085 | 362/108 |
| 8,453,357 | B2 * | 6/2013 | Beers | A43C 1/00 | 36/137 |
| 9,297,100 | B1 * | 3/2016 | Wu | D05B 1/20 | |
| 2007/0119358 | A1 | 5/2007 | Okita et al. | | |
| 2017/0009388 | A1 * | 1/2017 | Meiners | D05B 65/02 | |
| 2018/0044831 | A1 * | 2/2018 | Kansteiner | D05B 85/00 | |

FOREIGN PATENT DOCUMENTS

| | | | |
|---|---|---|---|
| JP | 2003169982 | A | 6/2003 |
| KR | 1020180103641 | A | 9/2018 |
| TW | 201002896 | A | 1/2010 |

OTHER PUBLICATIONS

U.S. Appl. No. 17/836,640, Yao, Priority Document.*
U.S. Appl. No. 17/934,045, Hsu, Priority Document.*
U.S. Appl. No. 17/935,510, Yao, Priority Document.*

* cited by examiner

THREAD BODY SEWING STRUCTURE

BACKGROUND OF THE INVENTION

Field of Invention

The invention relates to a sewing structure for fixing a thread body to prevent the thread body from being damaged and reducing its functions.

Related Art

Clothes are necessities for people. Clothes can be made with light-reflective function, such as sticking light-reflective strips or light-reflective sheets on clothes to reflect light is capable of improving the safety of people's activities at night and reducing the probability of accidents.

In terms of providing light-reflective effect, in addition to sticking light-reflective strips or light-reflective sheets mentioned above, another method is to sew light-reflective yarns on clothes, the surface of the light-reflective yarn is adhered with numerous tiny glass beads, and the light-reflective yarn can provide light-reflective effect to the clothes through the glass beads.

Because the light-reflective yarn is embedded with the glass beads, it is easy to break, so the bare light-reflective yarn cannot be sewn by a sewing machine directly. The light-reflective yarn must be twisted with other yarns into two or three strands of yarn before the light-reflective yarn can be sewn on clothes. However, the yarn diameter of the above-mentioned twisted multi-strand yarn is too thick and not fine, which increases the resistance of sewing.

Furthermore, although the light-reflective yarn can be sewn on clothes by twisting it with other yarns into multiple strands, the glass beads on the surface of the light-reflective yarn will fall off and damage the light-reflective yarn due to rubbing against the fabric during the process of passing through the fabric, and the glass beads on the surface of the light-reflective yarn are imperfect, which affects the light-reflective performance of the light-reflective yarn and causes defects in light-reflective clothing. The glass beads of the light-reflective yarn falling off during the sewing process is a problem that the industry cannot solve.

Other functional yarns, such as luminescent yarns with luminescent particles, yarns with metallic luster on the surface, or threads with conductive materials on the surface, if they are disposed on clothes by sewing, also have the same problem that the substances on the surface will fall off or be damaged due to the friction during the sewing process, causing the clothes to become defective products.

SUMMARY OF THE INVENTION

The invention aims to solve the above drawbacks, and its object is to provide a thread body sewing structure, through the sewing structure, the thread body can be fixed on an object without passing through the object to prevent the thread body from being damaged and affecting its functions.

The thread body sewing structure provided by the invention comprises: a sheet-shaped object provided for a sewing thread to be sewn thereon, the sheet-shaped object is a material that can be sewn with a sewing thread;

at least one upper thread sewn on the sheet-shaped object and located on a front side of the sheet-shaped object;

at least one lower thread disposed on the bottom side of the object, the lower thread and the upper thread are connected with each other; and at least one thread body disposed on the front side of the sheet-shaped object and disposed along a sewing direction of the upper thread, and the thread body is fixed on the front side of the sheet-shaped object by the upper thread without passing through the object.

With the above-mentioned sewing structure, the thread body is fixed on the front side of the sheet-shaped object by the upper thread, and does not need to pass through the object, so the thread body will not be damaged, and an integrity of its structure and existing functions can be maintained. Furthermore, since the thread body remains normal, the object containing the thread body will not become a defective product.

In addition, the thread body can be fixed without passing through the object, and can be used directly as a bare thread, which can reduce manufacturing costs, and because it does not need to be twisted together with other yarns to form a multi-strand thread, a thread diameter of the thread body will not become thicker and its original thread diameter can be maintained.

In one embodiment, the upper thread forms a plurality of seam sections on a surface of the sheet-shaped object along the sewing direction of the upper thread, and the thread body is fixed by the seam sections of the upper thread.

In one embodiment, the thread body passes/passes through the upper thread from two sides of the upper thread alternately.

In one embodiment, the thread body passes the adjacent seam sections in sequence and is pressed by the seam sections.

In one embodiment, the thread body passes the separated seam sections and is pressed by the separated seam sections.

In the above-mentioned embodiment, one the seam section or multiple the seam sections that does/do not press the thread body is/are disposed between two said separated seam sections that press the thread body.

In one embodiment, the thread body sewing structure has a plurality of thread bodies disposed along the sewing direction of the upper thread and pressed by at least one of the upper threads.

In one embodiment, it comprises two thread bodies and an upper thread, and the two thread bodies are symmetrically disposed on two sides of the upper thread.

The thread body can be various thread bodies, such as light-reflective yarn, luminescent yarn, thread body with metallic luster or thread body with conductivity. When the thread bodies are sewn on the object, they can be thread bodies with different functions.

The upper thread and the thread body form a composite sewing thread capable of being used as a sewing thread for the sheet-shaped object or as an embroidery thread for embroidering various embroidery patterns on the object.

BRIEF DESCRIPTION OF THE DRAWINGS

The objects, features, and achieved efficacies of the invention can be understood from the description and drawings of the following preferred embodiments, in which.

DETAILED DESCRIPTION OF THE INVENTION

Figure 1:
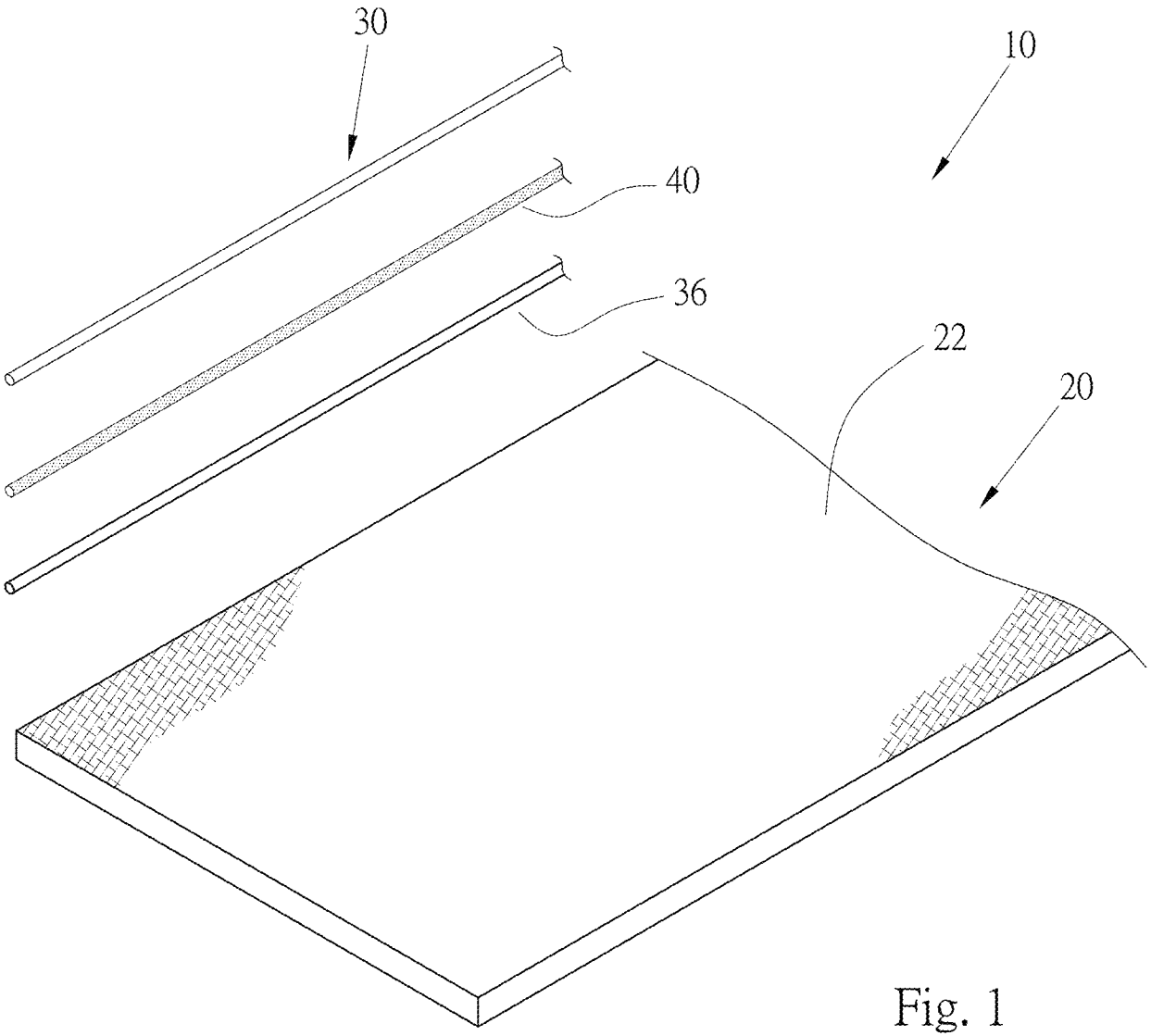
FIG. 1 is a schematic diagram of components of a thread body sewing structure according to a first preferred embodiment of the invention.

Please refer to FIG. 1, which shows components comprised in a thread body sewing structure provided by a first preferred embodiment of the invention, comprising: a sheet-shaped object 20, two sewing threads 30, 36, and a thread body (which can be a thread, a yarn or a fiber) 40, particularly a functional thread body (a functional thread, yarn or fiber), which is referred to as the thread body in this specification and the claims.

The sheet-shaped object 20 is a material that can be sewn with a sewing thread, and is flexible, such as fabric (cloth), leather (artificial or natural leather), plastic, paper, etc. The sheet-shaped object 20 in this embodiment is a fabric, the sheet-shaped object 20 has a front side 22 and a bottom side 24 on a side opposite to the front side 22. The sheet-shaped object 20 in this embodiment is exemplified as a fabric, which can be clothing, pant, shoe, sock, glove, hat, tie, scarf, handkerchief, silk scarf, neckerchief, or the like.

Figure 2:
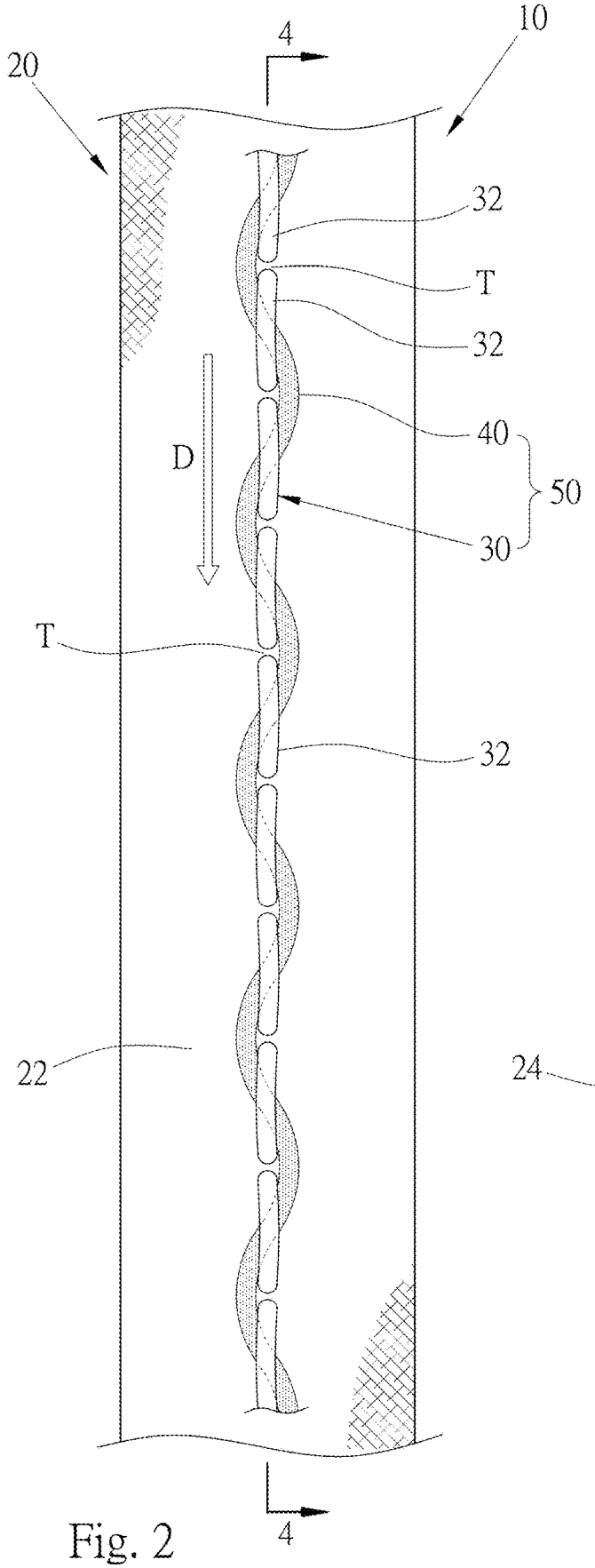
FIG. 2 is a top view of the thread body sewing structure according to the first preferred embodiment of the invention.
Figure 3:
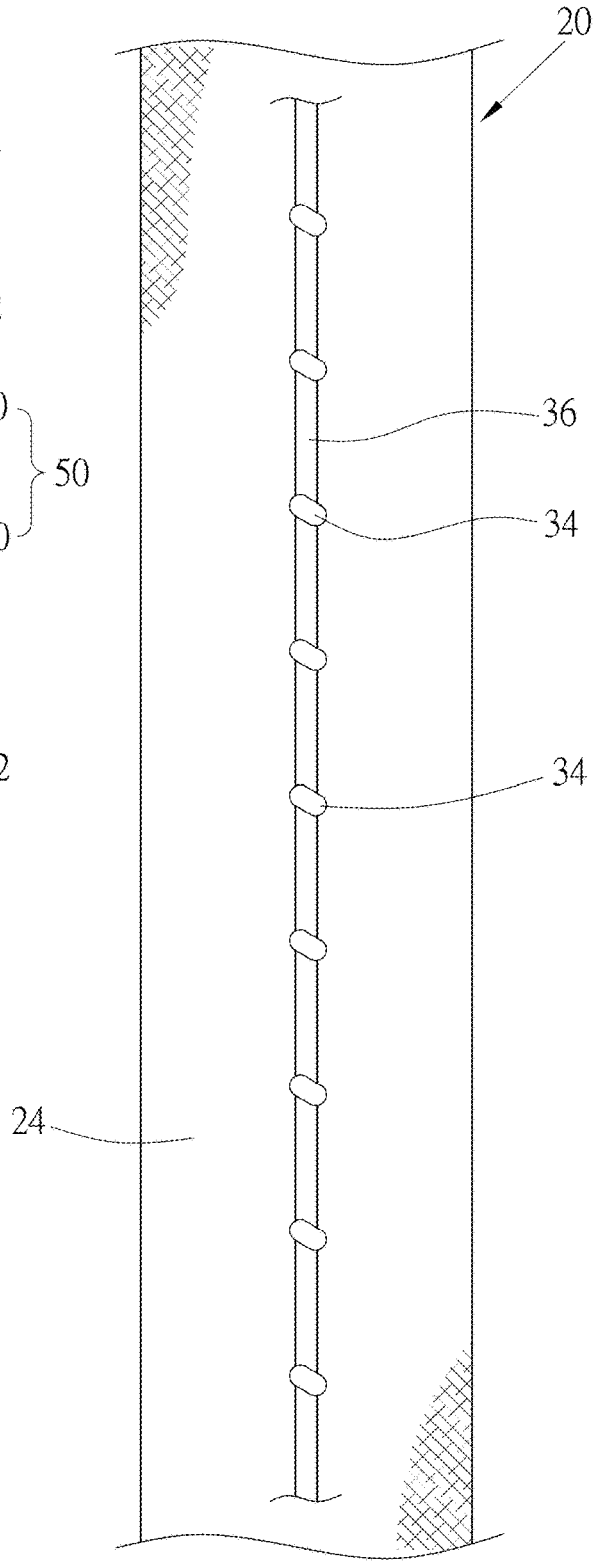
FIG. 3 is a bottom view of FIG. 2.

Please refer to FIG. 2 to FIG. 3, the two sewing threads 30, 36 are various threads that can be used for sewing, which can be made of artificial or natural materials, and are sewn on the sheet-shaped object 20 in a lockstitch sewing manner, the sewing thread 30 is an upper thread and is sewed on the front side 22 of the object 20, and the other sewing thread 36 is a lower thread and is disposed on the bottom side 24 of the object 20.

The thread body 40 is disposed on the front side 22 of the sheet-shaped object 20, and is pressed and fixed on the front side 22 of the sheet-shaped object by the upper thread 30 without passing through the sheet-shaped object. The thread body 40 can be a light-reflective yarn, a luminescent yarn, a thread body with metallic luster, or a thread body with conductivity. A surface of the light-reflective yarn has fine micro-glass beads, which are light-reflective. A surface of the luminescent yarn has luminescent particles capable of emitting luminescence in dark environment or environment with dim light. The thread body with metallic luster is composed of tiny substances of aluminum or silver mixed into the thread body of polymer material, which make an exterior of the thread body produce metallic luster, and can be made with metallic luster of different colors. The thread body with conductivity is made by mixing conductive materials into a polymer thread body to have conductivity; a metal thread body, such as a copper thread, can also be used as the conductive thread body of the invention. In this embodiment, the light-reflective yarn is used as the thread body 40.

In the embodiment, the two sewing threads 30, 36 are sewn on the object 20 in a lockstitch sewing manner, and the thread body 40 is fixed by the upper thread 30 during a sewing process. A sewing machine is used to sew the two sewing threads 30, 36 and the thread body 40 on the object 20, and a structure for laying the thread body 40 is a mechanism additionally installed on the sewing machine, the mechanism is not a subject matter of the invention and thus will not be described herein.

Figure 4:
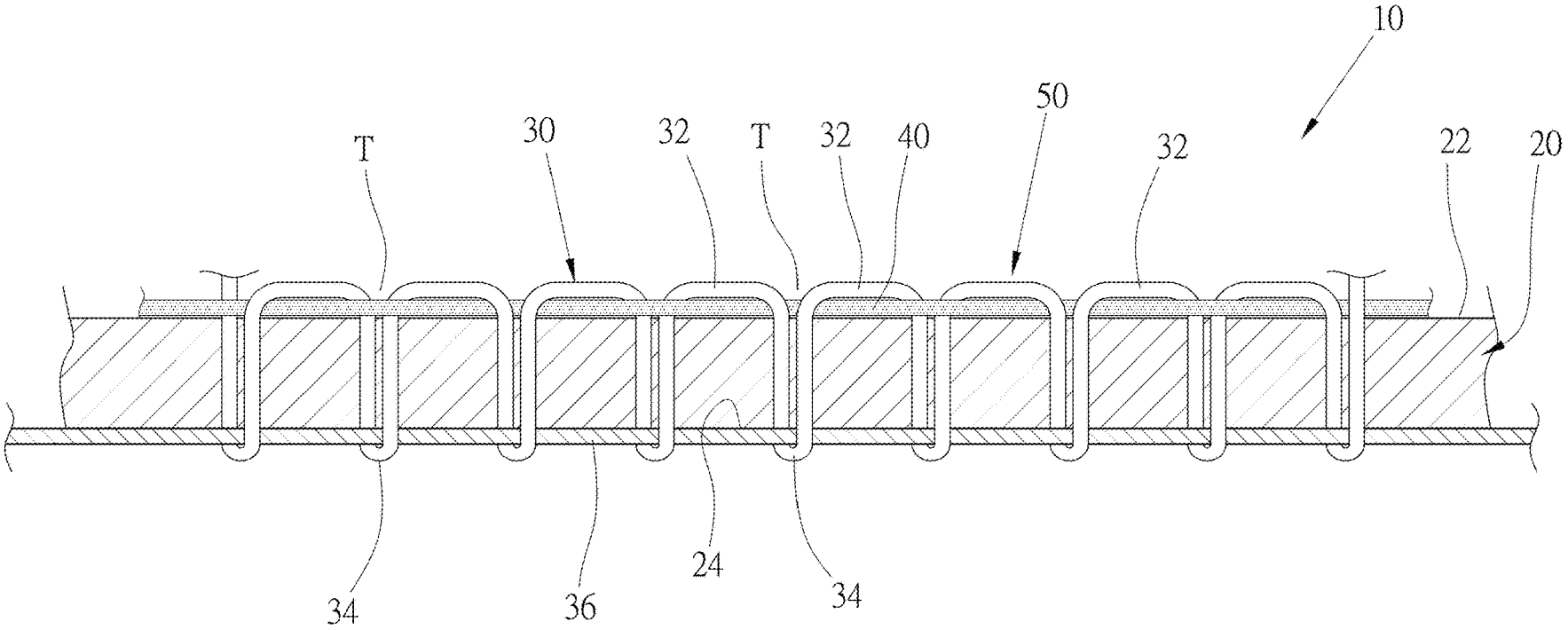
FIG. 4 is a cross-sectional view taken along section line 4-4 of FIG. 2.

Please refer to FIG. 4, in a lockstitch sewing process, a sewing needle (not shown in the figure) of the sewing machine performs a stitching at a stitching point T, at the stitching point T, the sewing needle pierces through the object (such as a fabric) 20 and drives the upper thread 30 to penetrate from the front side 22 of the fabric 20 to reach the bottom side 24 of the fabric 20, and then the sewing needle pulls the upper thread 30 upward back to the front side 22 of the fabric 20, thereby the sewing needle completes a lockstitch sewing stroke. During a sewing stroke, the upper thread 30 produces a turn at the bottom side 24 of the fabric 20, and the turn forms a cross portion 34 that crosses the lower thread 36. When a next sewing stroke is performed, the object 20 is pushed and moved by the sewing machine for a certain distance, the sewing needle performs another sewing stroke at the other stitching point T, and the upper thread 30 penetrates to reach the bottom side 24 of the fabric 20 again, and then the upper thread 30 is pulled back to the front side 22 of the fabric 20. Thereby, sewing stroke of stitching is repeatedly performed. In each sewing stroke, the upper thread 30 forms the cross portion 34 at the bottom side 24 of the fabric 20, and crosses the lower thread 36, so that the lower thread 36 and the upper thread 30 are hooked with each other at the bottom side 24 of the fabric 20. At the same time, on the front side 22 of the object 20, the upper thread 30 forms a seam section 32 at every two adjacent stitching point T, and the seam sections 32 are arranged along a sewing direction D of the sewing thread 30. Usually, the seam sections 32 are of a same length and arranged at equal intervals. Two ends of each of the seam sections 32 are arranged along the sewing direction D of the sewing thread 30, in which a first end of each of the seam sections 32 is adjacent to a second end of an adjacent seam section 32. The sewing direction D shown in the figures is in a straight direction as an example, the sewing direction D of the sewing thread 30 is not limited to straight direction, and can be various sewing directions such as arc direction, polygonal direction, or zigzag direction.

Figure 5:
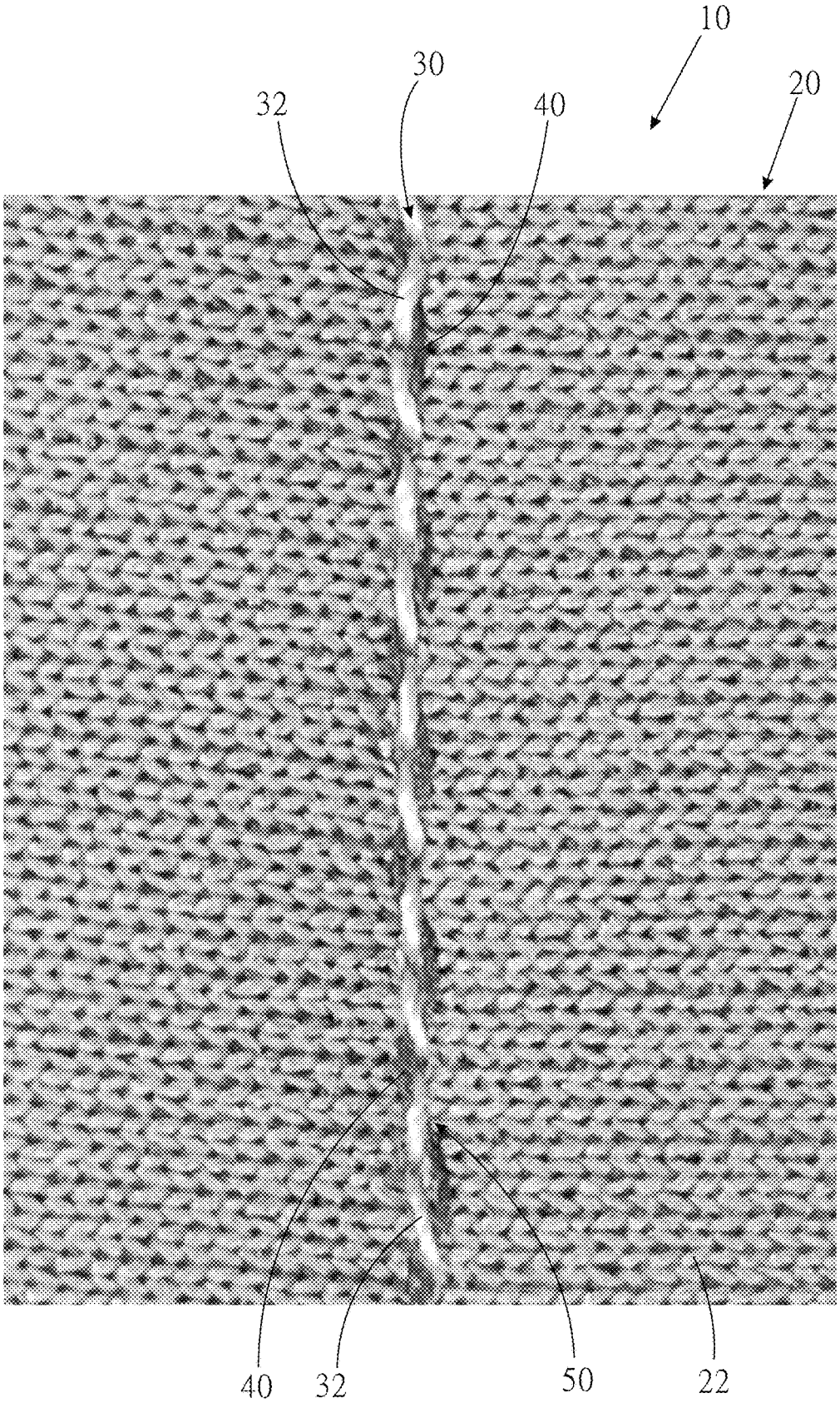
FIG. 5 is a top view of an object photo of the thread body sewing structure according to the first preferred embodiment of the invention.
Figure 6:
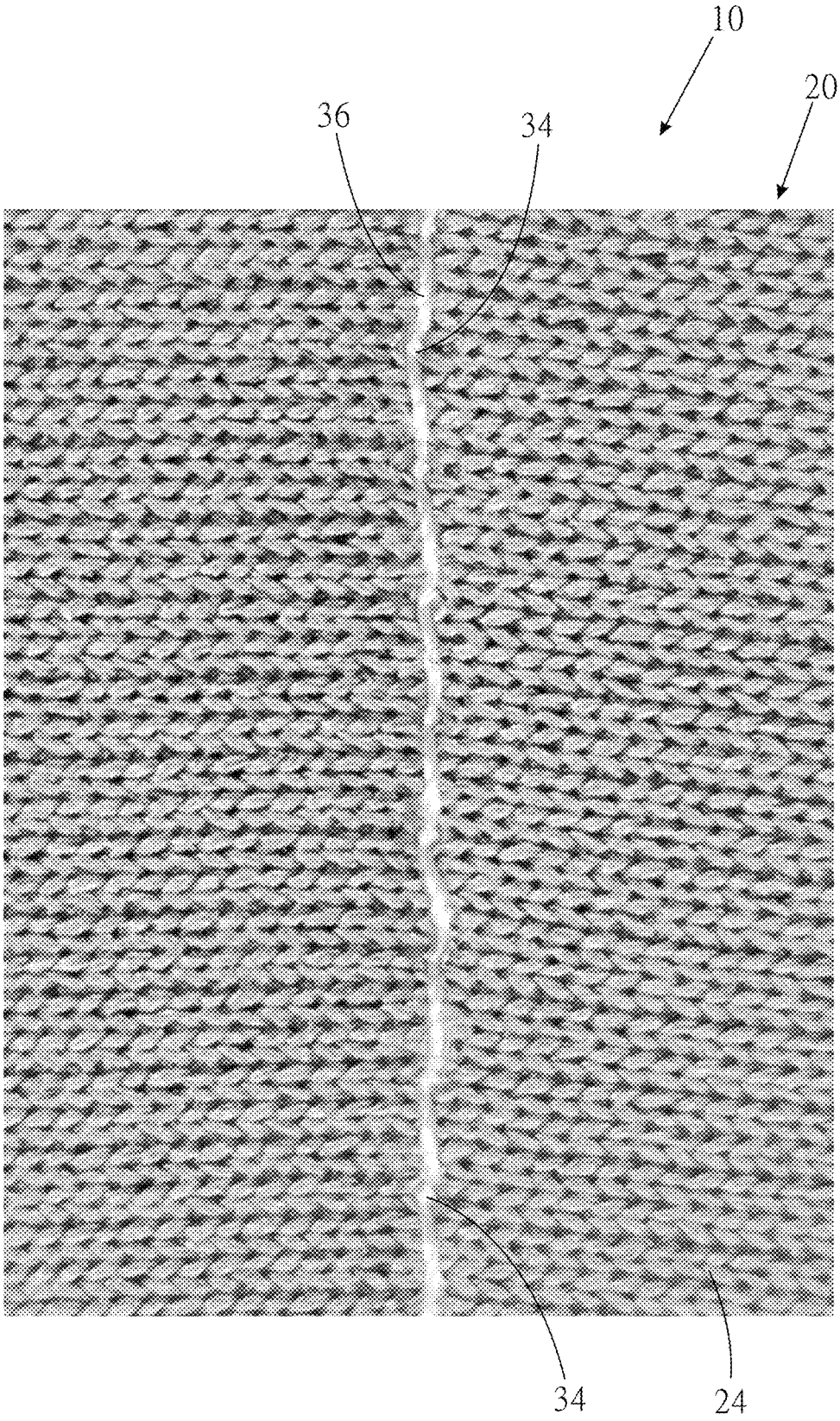
FIG. 6 is a bottom view of the object photo of FIG. 5.

The thread body 40 is laid along a routing direction of the upper thread 30, that is, a laying direction of the thread body 40 is disposed along a sewing direction of the upper thread 30, the thread body 40 is pressed by the seam sections 32 of the upper thread 30, and thus is fixed on the front side 22 of the object 20. During a sewing process, in addition to continuous release of the sewing threads 30, 36, the thread body 40 is also continuously released, and the thread body 40 is threaded under the seam sections 32 in sequence and is pressed by the seam sections 32. FIGS. 5 and 6 are object photos of a thread body sewing structure 10 of the invention, and structures thereof are shown in FIGS. 2 and 3.

Figure 7A:
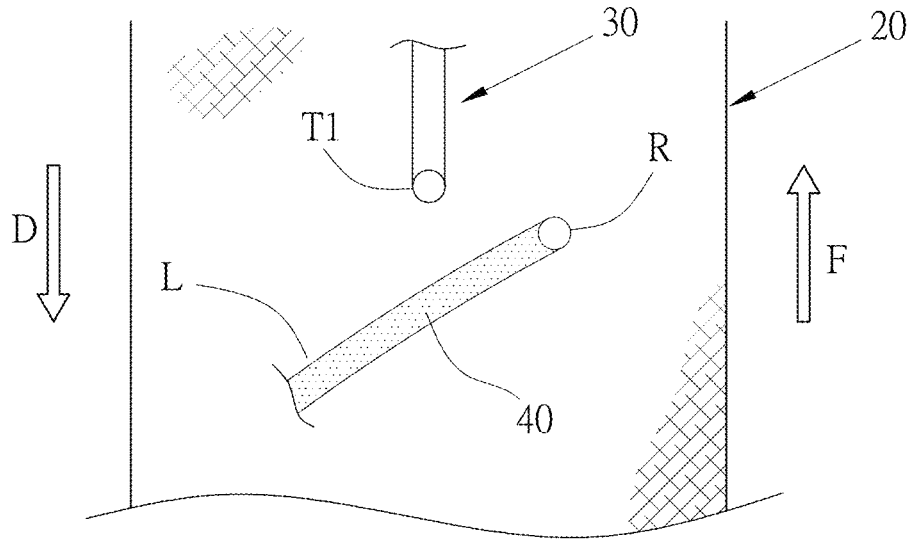
FIGS. 7A to 7C are schematic diagrams of a manufacturing process of the thread body sewing structure of FIG. 2.
Figure 7B:
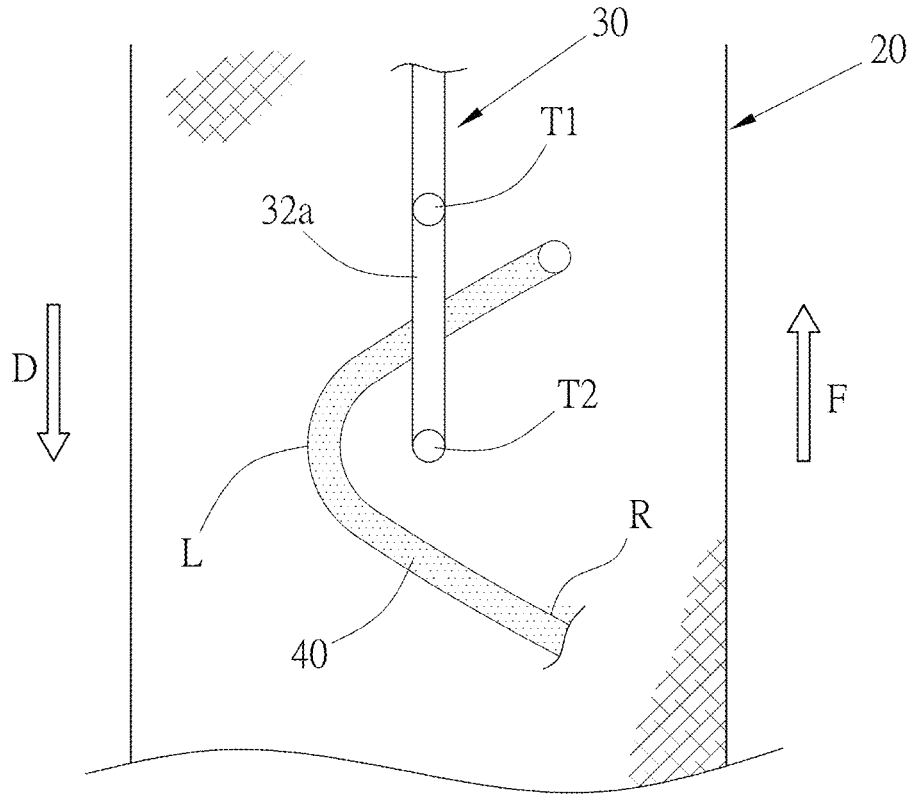
Figure 7C:
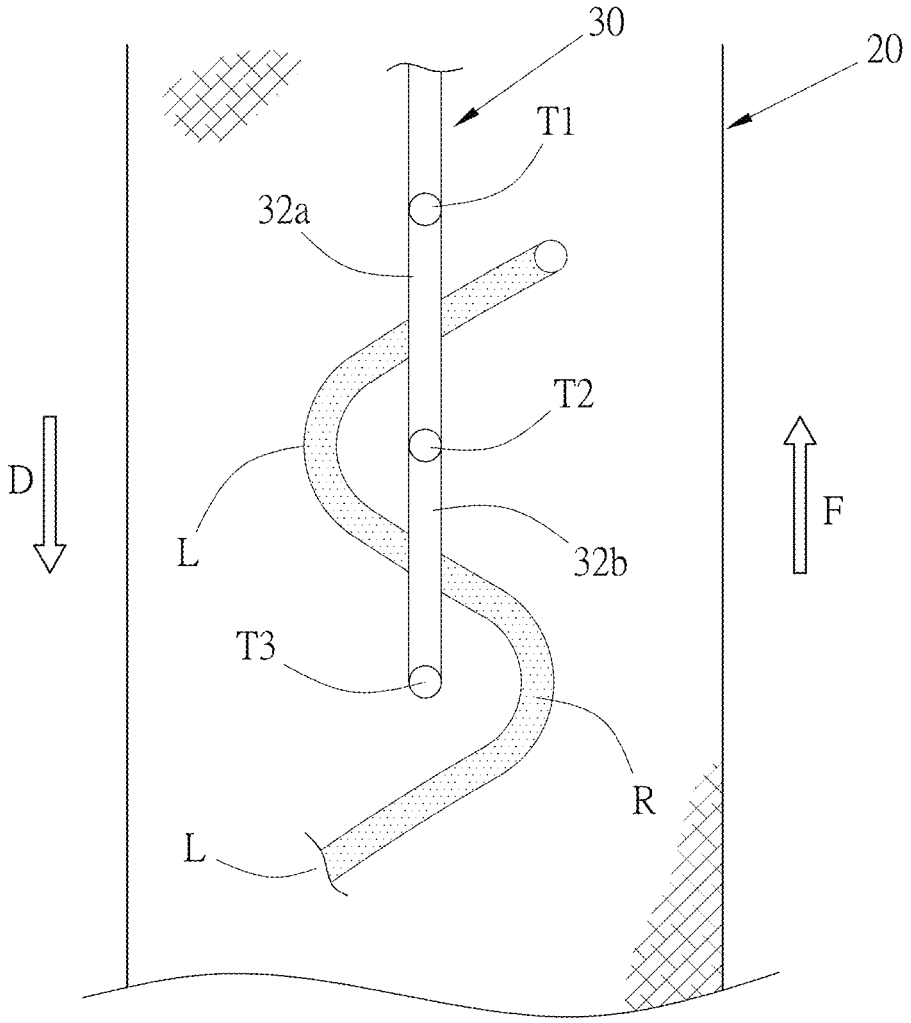

FIG. 7 shows schematic diagrams of a sewing process of the upper thread 30 and the thread body 40. As shown in FIG. 7A, the thread body 40 is first released from one side (e.g., right side R) to another side (e.g., left side L), and then, as shown in FIG. 7B, the sewing needle performs a sewing stroke at another stitching point T2, and a seam section 32*a* is produced between the stitching points T1 and T2 and it press the thread body 40. Then the thread body 40 is pulled from the left side L to the right side R. As shown in FIG. 7C, the sewing needle performs a sewing stroke at a next stitching point T3, so that the upper thread 30 produces another seam section 32*b*, and the thread body 40 is pressed. By repeating this process, the thread body sewing structure 10 of the invention can be completed by sewing. The thread body 40 is threaded under the seam sections 32 in a wave-like shape, the thread body 40 passes/passes through the upper thread 30 from two sides of the upper thread 30 alternately. In the figures, F shows a moving direction of the object 20 during a sewing process, and D is the sewing direction of the sewing threads 30, 36.

The upper thread 30 and the thread body 40 form a composite sewing thread 50, which is sewn onto the object 20 and is arranged on the front side 22 (outwardly facing surface) of the object.

In the first preferred embodiment shown in FIG. 2, the thread body 40 is threaded under the adjacent seam sections 32 sequentially and regularly, and is pressed by each of the seam sections 32.

Figure 8:
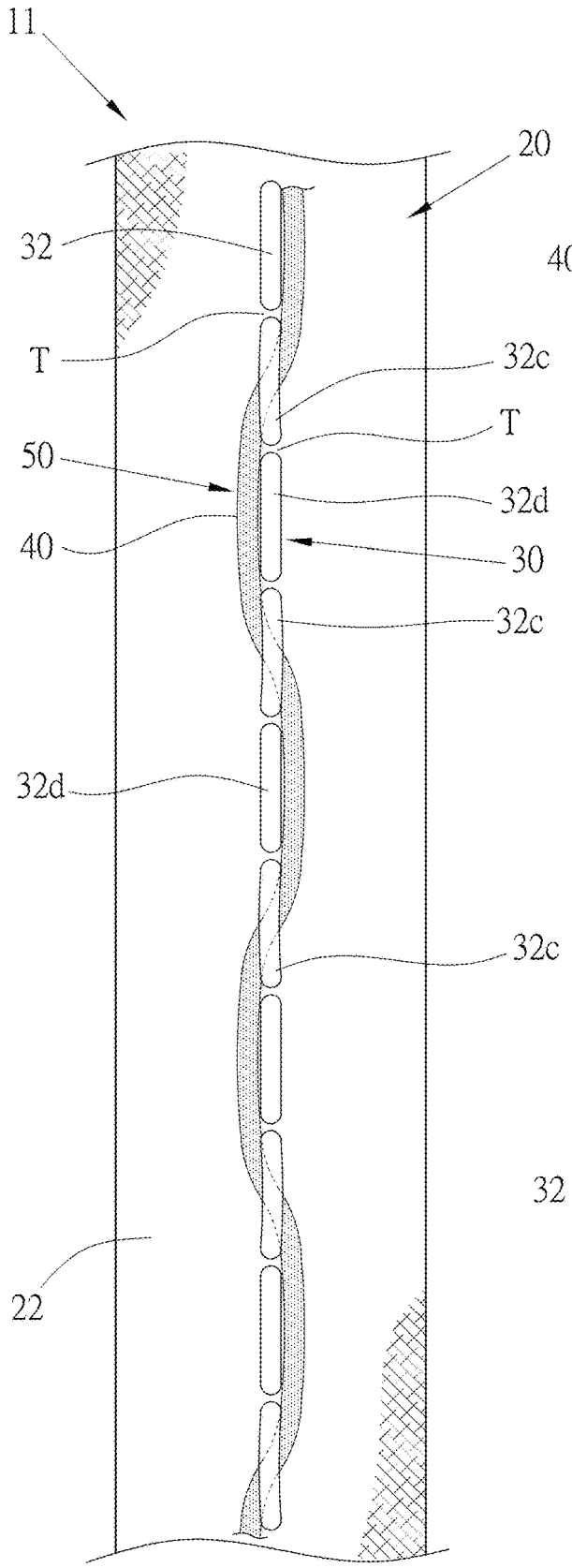
FIG. 8 is a top view of the thread body sewing structure according to a second preferred embodiment of the invention.

FIG. 8 shows a thread body sewing structure 11 provided by a second preferred embodiment of the invention, which also comprises: a sheet-shaped object 20, two sewing threads (the upper thread and the lower thread) 30, 36 (the lower thread 36 is not shown in the figure), and a thread body 40, the same components use the same reference numerals, and each of the components can be understood from the description of the previous preferred embodiment, which will not be repeated herein.

In this embodiment, the thread body 40 does not pass under all the seam sections 32, but regularly passes under the separated seam sections 32 and is pressed by the separated seam sections 32. As shown in FIG. 8, the seam sections 32*c* that press/press against the thread body 40 are spaced apart, and a seam section 32*d* located between every two separated seam sections 32*c* does not press/press against the thread body 40. The seam section 32*d* or the seam sections 32*d* that does/do not press the thread body 40 can be disposed between the two separated seam sections 32*c* that press the thread body 40. FIG. 8 shows that two adjacent seam sections 32*c* that press the thread body 40 are separated by the seam section 32*d* that does not press the thread body 40.

The thread body 40 and the upper thread 30 pressing the thread body 40 form the composite sewing thread 50 of this embodiment, which is sewn on the object 20 and located on the front side 22.

Figure 9:
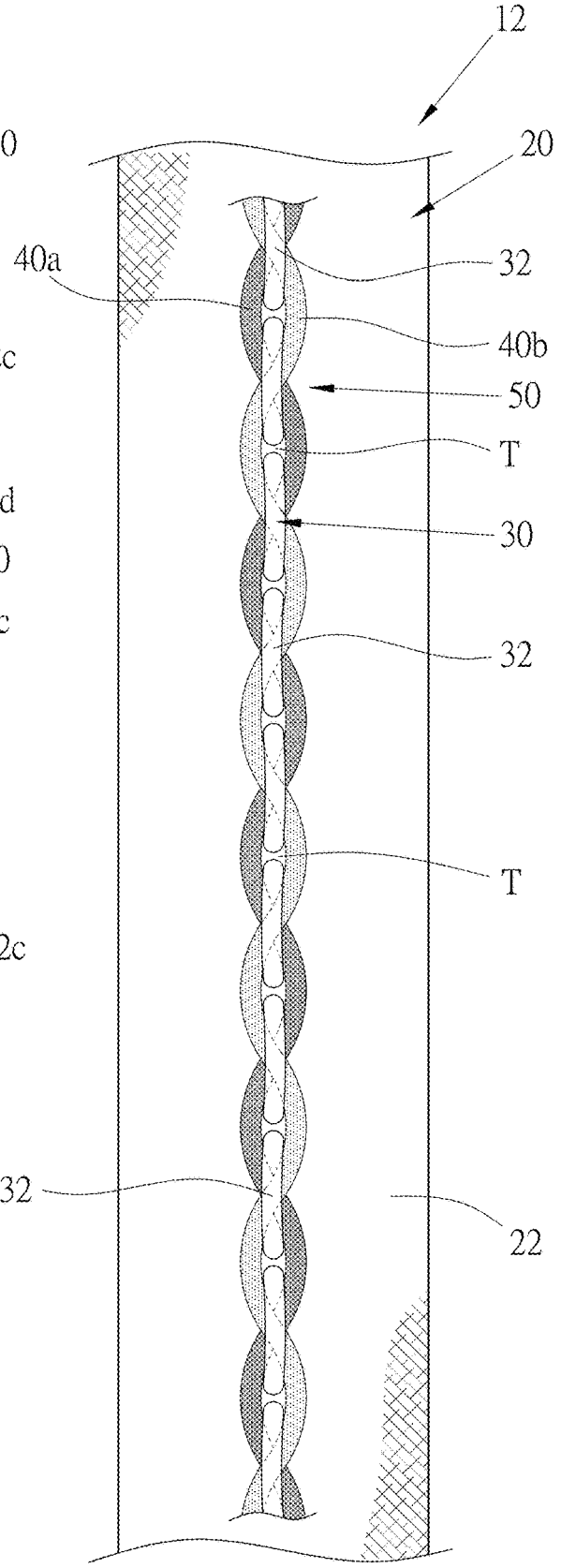
FIG. 9 is a top view of the thread body sewing structure according to a third preferred embodiment of the invention.

FIG. 9 shows a thread body sewing structure 12 provided by a third preferred embodiment of the invention, which also comprises: a sheet-shaped object 20, two sewing threads (the upper thread and the lower thread) 30, 36 (the lower thread 36 is not shown in the figure), and thread bodies 40 (40*a*, 40*b*), and the same components use the same reference numerals.

This embodiment shows that two thread bodies 40*a*, 40*b* are disposed on the front side 22 of the sheet-shaped object 20 and are pressed by the seam sections 32 of the upper thread 30. The two thread bodies 40*a*, 40*b* can be symmetrically disposed on the object 20 and on two sides of the upper thread 30 as shown in FIG. 9. The two thread bodies 40*a*, 40*b* are threaded under the seam sections 32 and are pressed by the seam sections 32. When the two thread bodies 40*a*, 40*b* are symmetrically disposed, the seam sections 32 simultaneously press/press against the two thread bodies 40*a*, 40*b*. It can be understood that the two thread bodies 40*a*, 40*b* can also be asymmetrically disposed on the object 20.

FIG. 9 shows that the two thread bodies 40*a*, 40*b* pass under the adjacent seam sections 32 in sequence, and are fixed on the front side 22 of the object 20 by being pressed by the seam sections 32. Likewise, as shown in FIG. 8, the two thread bodies 40*a*, 40*b* may pass under the separated/spaced-apart seam sections 32 and are pressed by the spaced-apart seam sections 32. An interval at which the two thread bodies 40*a*, 40*b* being pressed by the seam sections 32 can be different. For example, every two separated seam sections 32 that press/press against the thread body 40*a* are separated by one seam section 32 that does not press the thread body 40*a*, and every two separated seam sections 32 that press the thread body 40*b* are separated by two seam sections 32 that do not press the thread body 40*b*.

The two thread bodies 40*a*, 40*b* can be thread bodies with a same function or thread bodies with different functions, for example, the two thread bodies 40*a*, 40*b* are both light-reflective yarns, luminescent yarns, thread bodies with metallic luster, or thread bodies with conductivity; when the two thread bodies 40*a*, 40*b* are thread bodies with different functions, one of the thread bodies 40*a*, 40*b* is a light-reflective yarn, and the other thread body (40*a* or 40*b*) can be a luminescent yarn, a thread body with metallic luster or a thread body with conductivity, and so on.

The two thread bodies 40 and the upper thread 30 pressing the two thread bodies 40 form the composite sewing thread 50 of this embodiment, which is sewn onto the object 20. It can be seen from the above figures that the composite sewing thread 50 of the invention can be used as a sewing thread for sewing on the object 20, for example, as shown on a lower left side of the object (e.g., cloth) 20 in FIG. 10, the composite sewing thread 50 can be used as a sewing thread sewn on an edge of the object 20.

Figure 10:
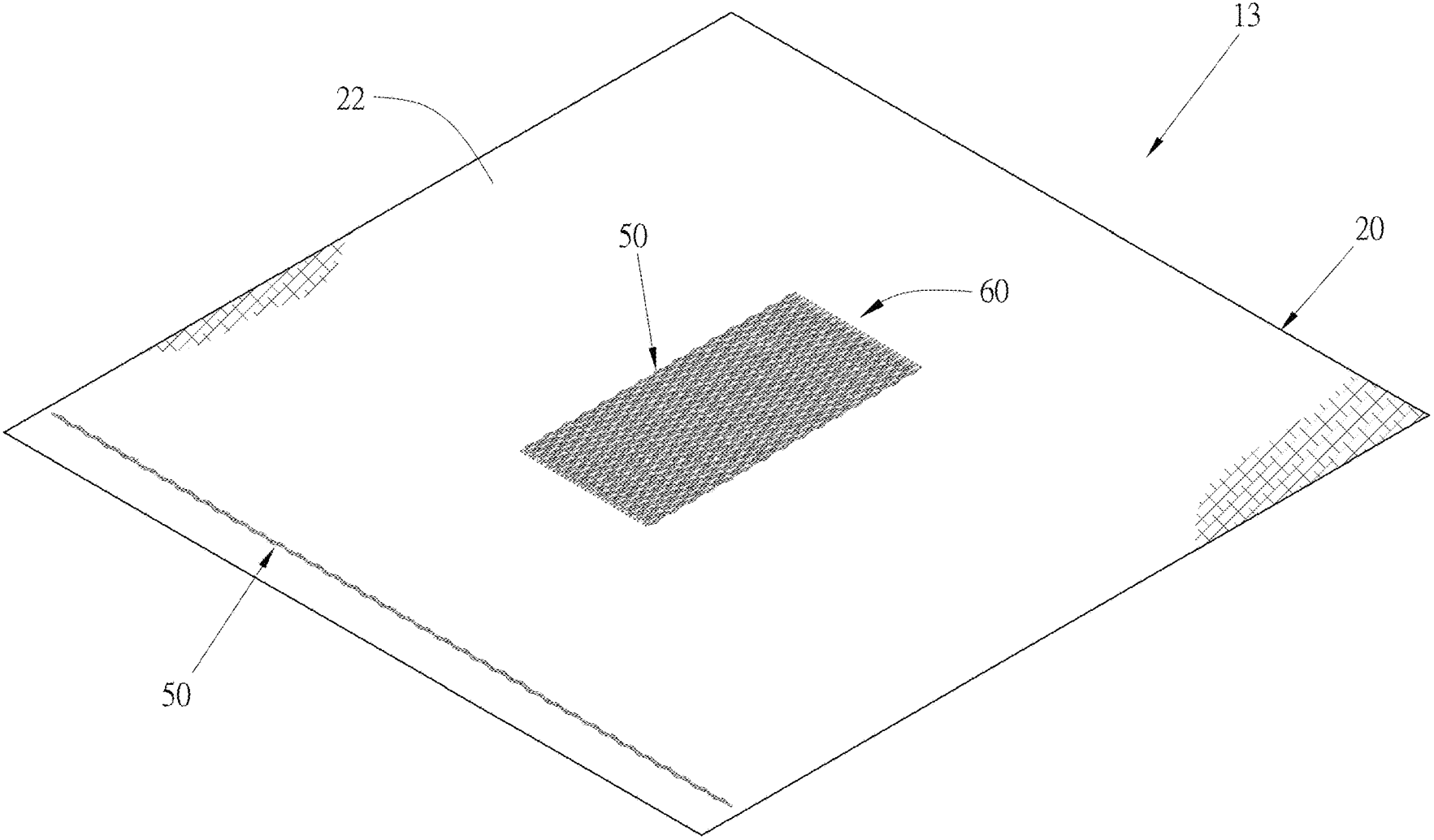
FIG. 10 is a schematic diagram of embroidering an embroidery pattern with a composite sewing thread of the invention.

FIG. 10 is an application example of a thread body sewing structure 13 of the invention, which shows that the composite sewing thread 50 can also be used as an embroidery thread. An embroidery pattern 60 in various forms and shapes is embroidered on the object 20 with the composite sewing thread 50 by a sewing machine or an electric embroidery machine (not shown in the figure), and the pattern 60 can be various patterns (e.g., flower, trademark logo) or characters. The embroidery pattern 60 in FIG. 10 is only an example.

FIGS. 11 to 15 show several embodiments of the thread body sewing structure of the invention completed by using different sewing machines, such as thread babylock/thread overlock, thread coverstitch/thread coverstitch with binding, or flatlock. Thread babylock, thread overlock can be divided into models with one needle (one sewing needle) and three threads (three sewing threads), two needles and four threads; thread coverstitch, thread coverstitch with binding has models with two needles and three threads, two needles and four threads, three needles and five threads; and flatlock is a sewing machine with four needles and six threads. In order to sew the thread body 40 of the invention, various sewing machines described below are equipped with a laying mechanism for laying the thread body 40.

Figure 11B:
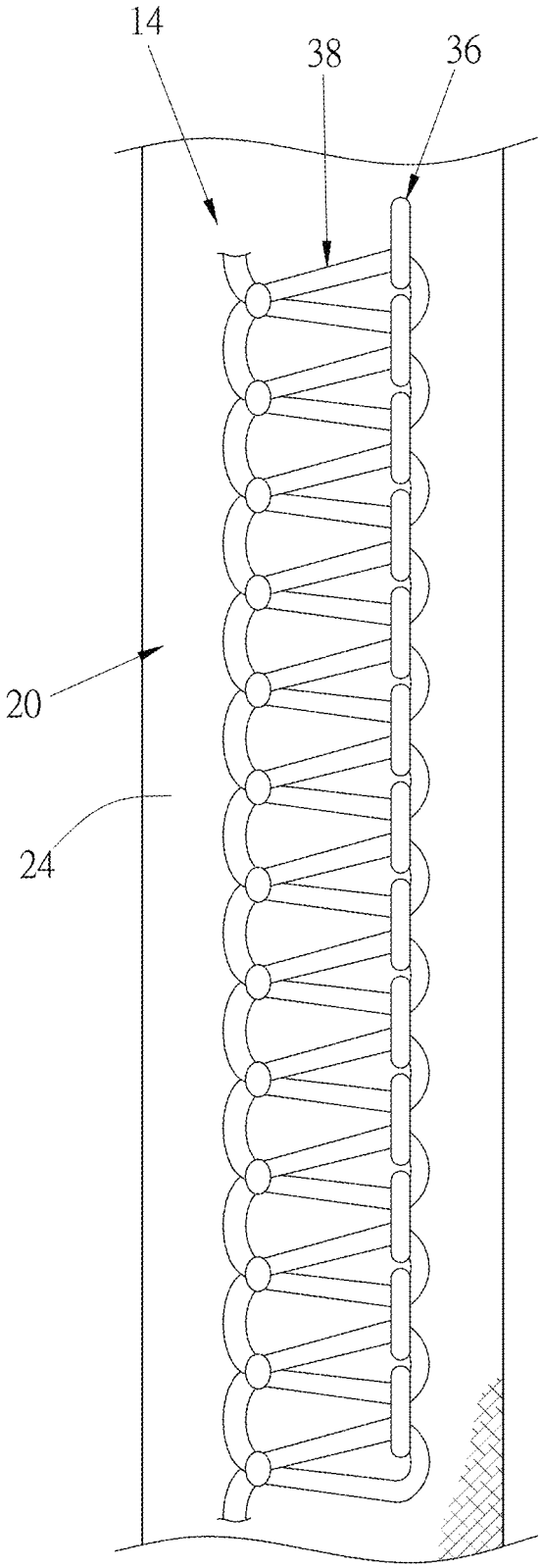
FIGS. 11A and 11B are respectively a top view and a bottom view of the thread body sewing structure according to a fourth preferred embodiment of the invention.
Figure 11A:
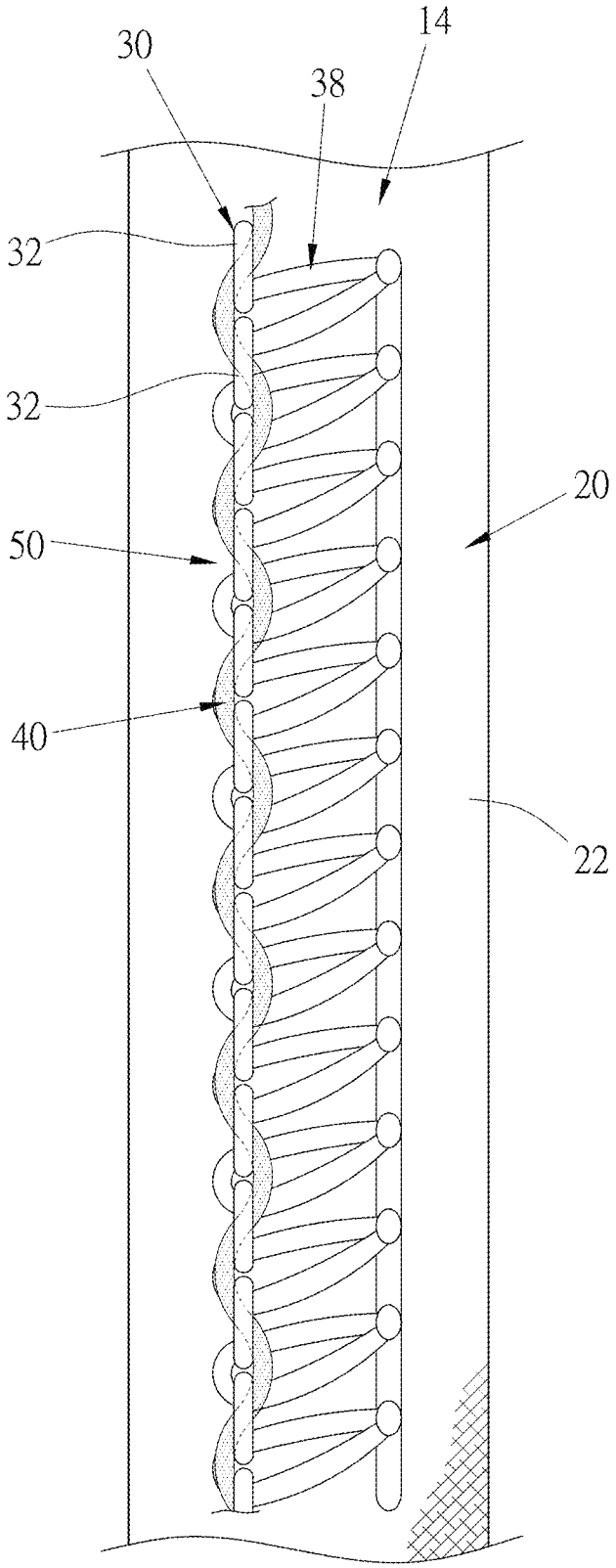

FIGS. 11A and 11B show a front side (FIG. 11A) and a back side (FIG. 11B) of a thread body sewing structure 14 sewed by a one-needle three-thread thread babylock/thread overlock according to the invention, which comprises three sewing threads and a thread body (light-reflective yarn, luminescent yarn, conductive thread body, etc.) 40. One of the three sewing threads is the upper thread 30 sewed on the front side 22 of the object 20, and has seam sections 32 arranged linearly along a sewing direction; the other two sewing threads are the lower thread 36 and a cross thread 38 respectively. The thread body 40 is arranged on the front side 22 of the object 20, and is pressed by the seam sections 32 of the upper thread 30 and fixed on the front side 22 of the object 20. A connection structure between the three sewing threads 30, 36, 38 is not a subject matter of the invention, and thus will not be described herein.

Figure 12B:
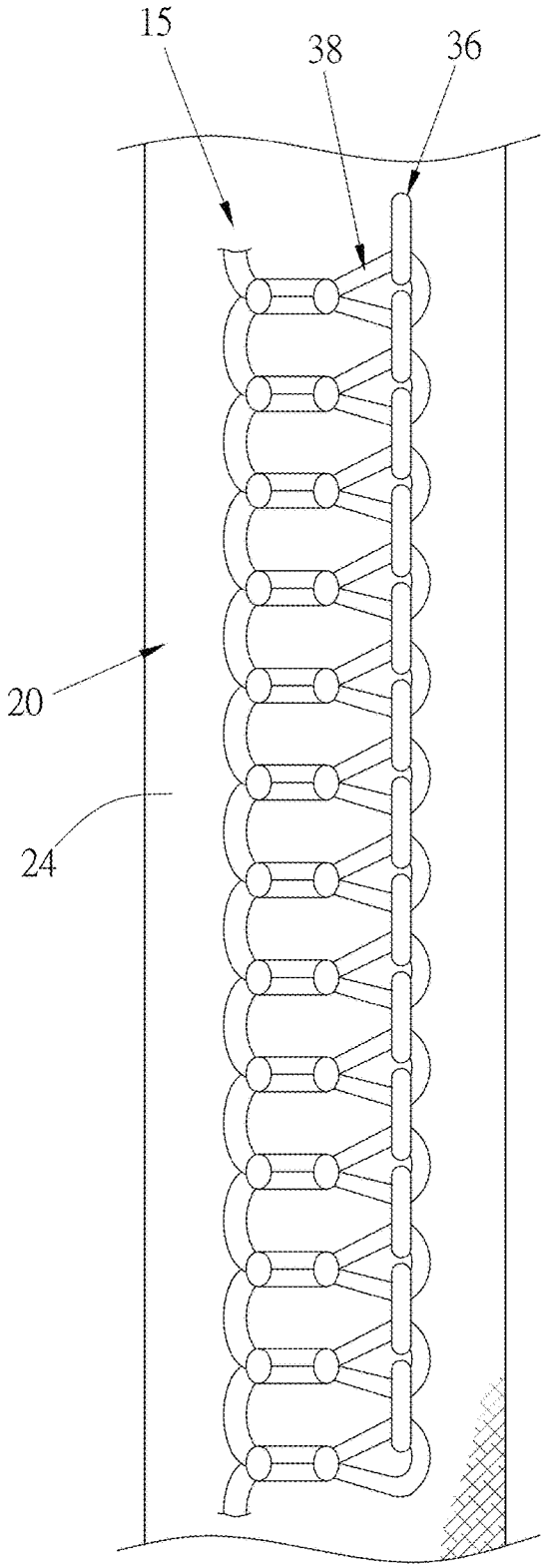
FIGS. 12A and 12B are respectively a top view and a bottom view of the thread body sewing structure according to a fifth preferred embodiment of the invention.
Figure 12A:
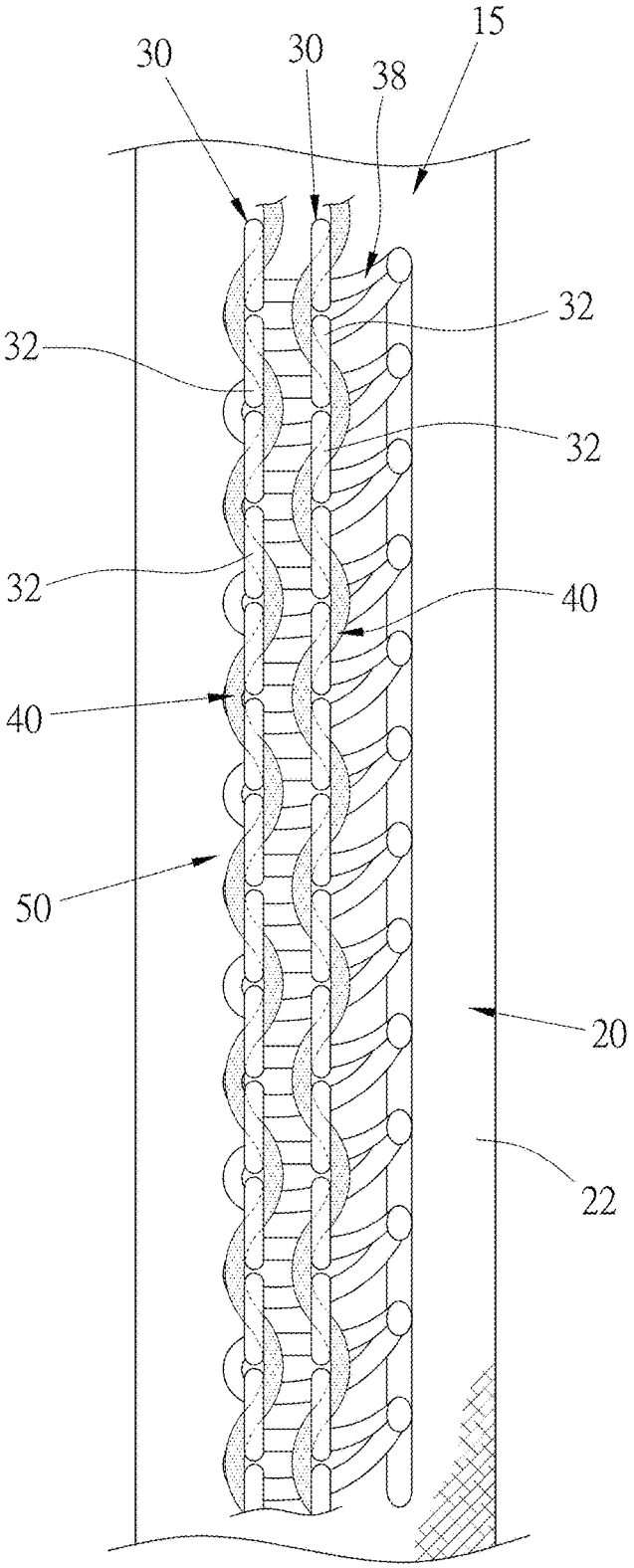

FIGS. 12A and 12B show a front side and a back side of a thread body sewing structure 15 sewed by a two-needle four-thread thread babylock/thread overlock according to the invention, which comprises four sewing threads and two thread bodies 40. Two of the four sewing threads are the upper threads 30 of the front side 22 of the object 20, and each of the upper threads 30 has seam sections 32 extending linearly. The other two sewing threads are the lower thread 36 and the cross thread 38 respectively. The two thread bodies 40 are respectively pressed by the seam sections 32 of the two upper threads 30 and fixed on the front side 22 of the object 20. Likewise, a connection structure between the three sewing threads 30, 36, 38 is not a subject matter of the invention.

Figure 13B:
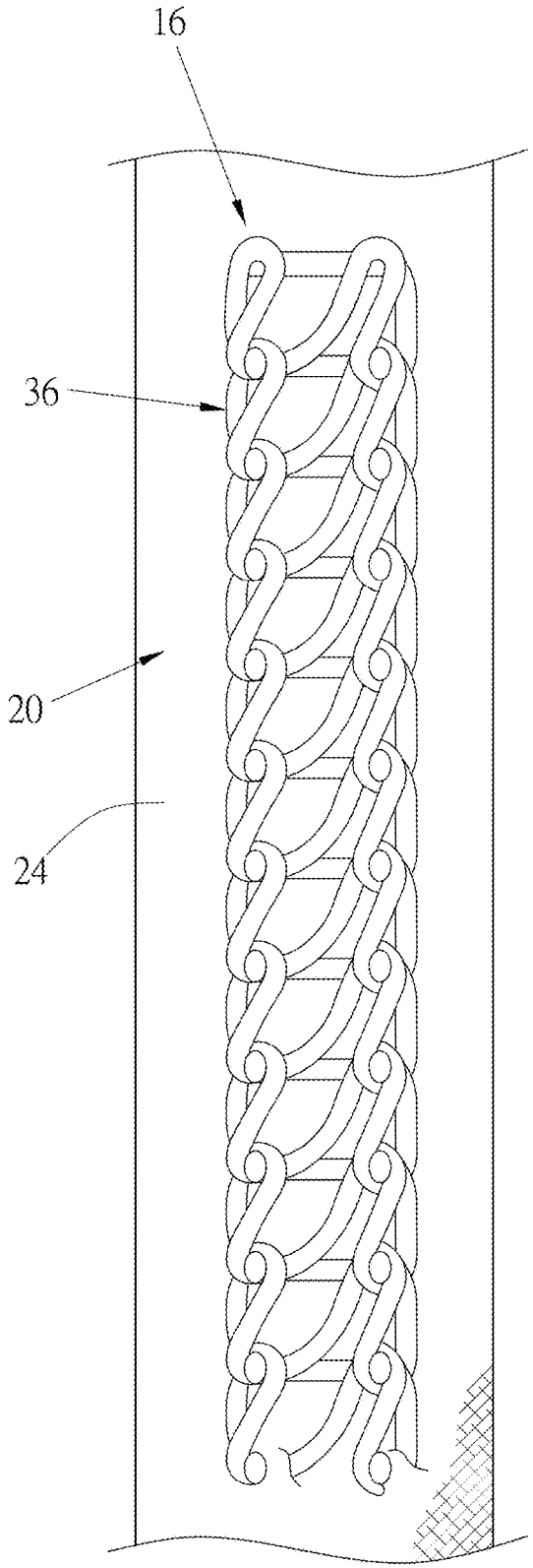
FIGS. 13A and 13B are respectively a top view and a bottom view of the thread body sewing structure according to a sixth preferred embodiment of the invention.
Figure 13A:
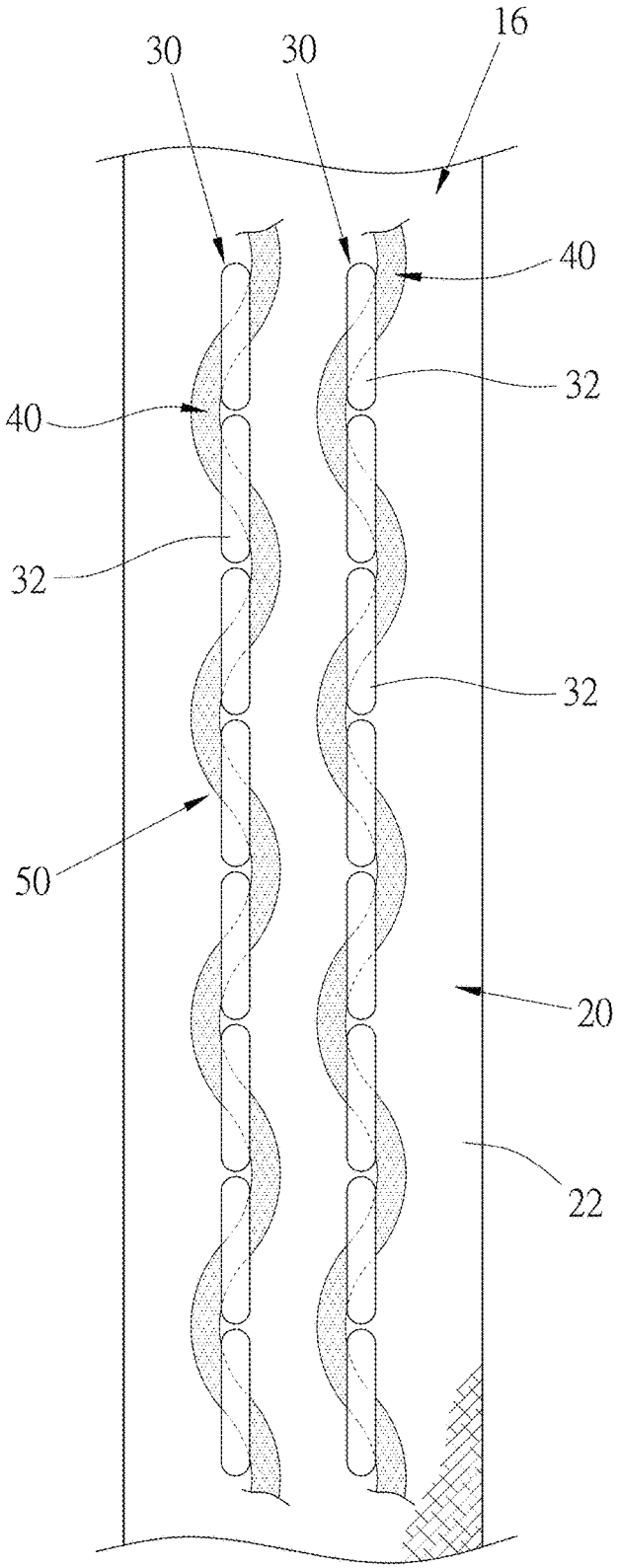

FIGS. 13A and 13B show a front side and a back side of a thread body sewing structure 16 sewed by a two-needle three-thread thread coverstitch/thread coverstitch with binding according to the invention, which comprises three sewing threads and two thread bodies 40, two of the sewing threads are the upper threads 30 located on the front side 22 of the object 20 and have seam sections 32 extending linearly. The other sewing thread is the lower thread 36. The two thread bodies 40 are respectively pressed by the seam sections 32 of the two upper threads 30 and fixed on the front side 22 of the object 20.

Figure 14B:
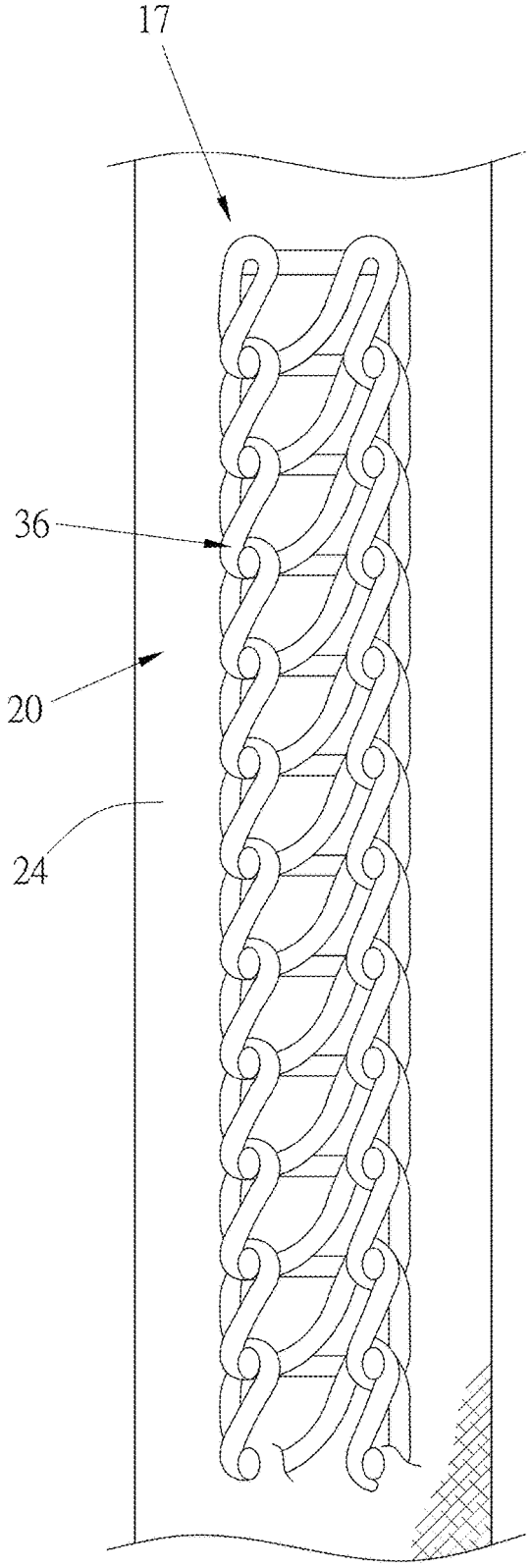
FIGS. 14A and 14B are respectively a top view and a bottom view of the thread body sewing structure according to a seventh preferred embodiment of the invention.
Figure 14A:
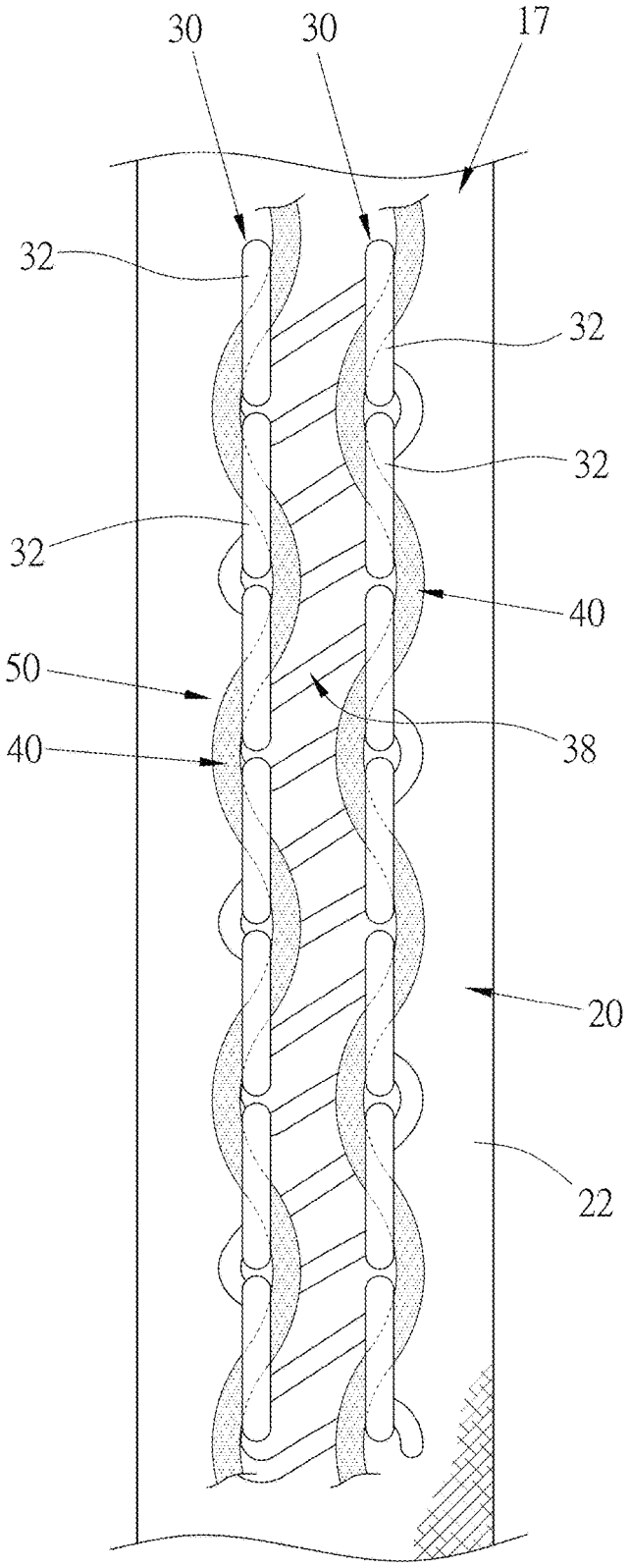

FIGS. 14A and 14B show a front side and a back side of a thread body sewing structure 17 sewed by a two-needle four-thread thread coverstitch/thread coverstitch with binding according to the invention, which comprises four sewing threads and two thread bodies 40, two of the sewing threads are the upper threads 30 and each of the upper threads 30 has seam sections 32 extending linearly. The other two sewing threads are the lower thread 36 and the cross thread 38 respectively. The two thread bodies 40 are respectively pressed by the seam sections 32 of the two upper threads 30 and fixed on the front side 22 of the object 20.

Figure 15B:
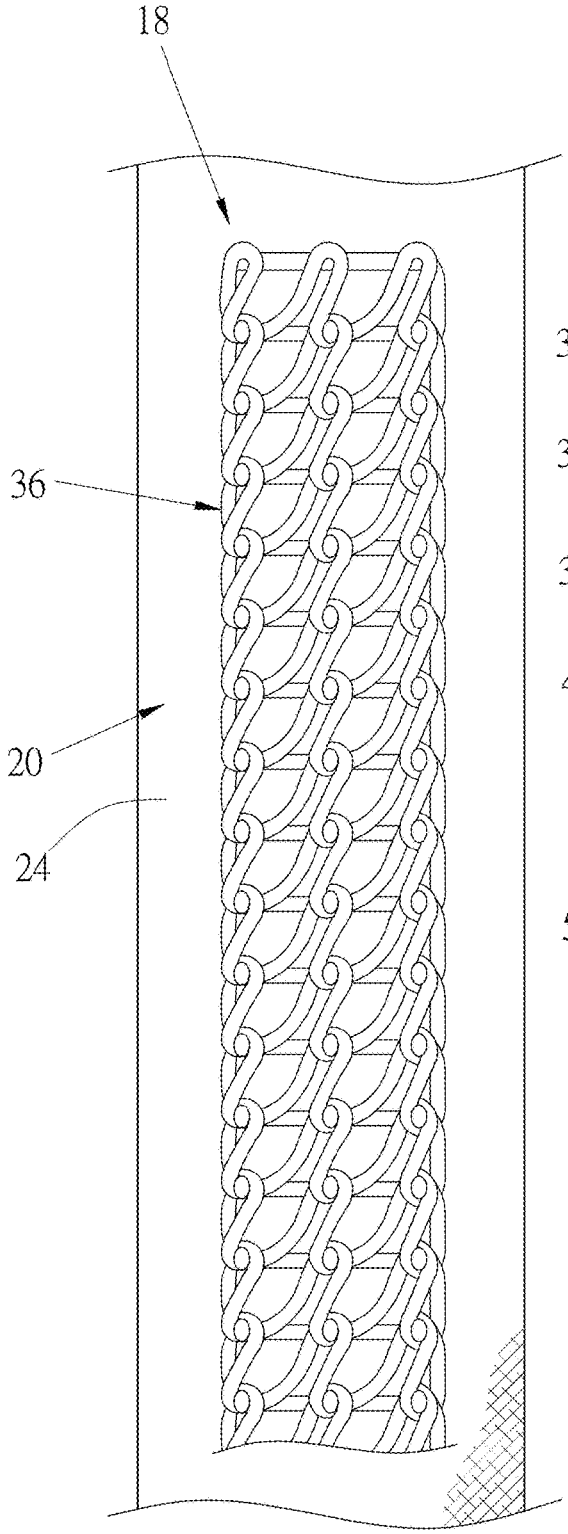
FIGS. 15A and 15B are respectively a top view and a bottom view of the thread body sewing structure according to an eighth preferred embodiment of the invention.
Figure 15A:
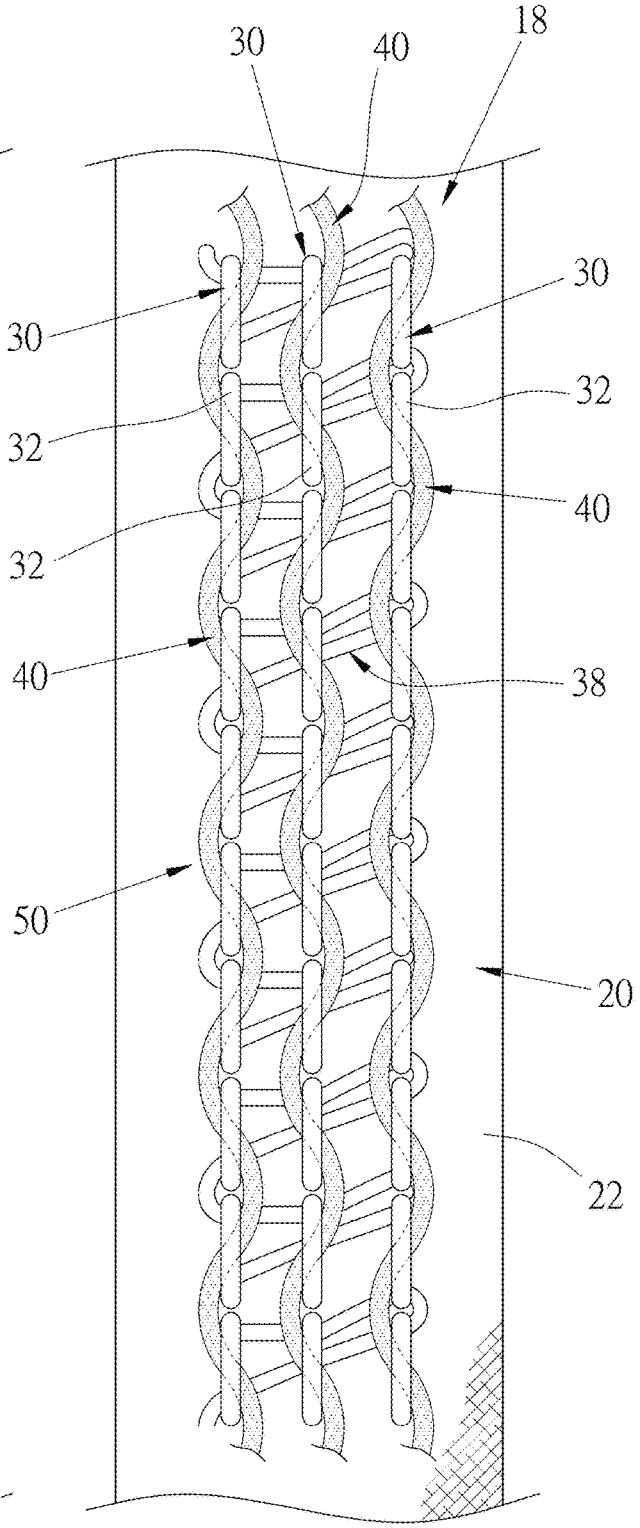

FIGS. 15A and 15B show a front side and a back side of a thread body sewing structure 18 sewed by a three-needle five-thread thread coverstitch/thread coverstitch with binding according to the invention, which comprises five sewing threads and three thread bodies 40, three of the sewing threads are the upper threads 30 sewn on the front side 22 of the object 20 and have seam sections 32. The other two sewing threads are the lower thread 36 and the cross thread 38 respectively. The three thread bodies 40 are respectively pressed by the seam sections 32 of the three upper threads 30 and fixed on the front side 22 of the object 20.

A four-needle six-thread flatlock sewing thread structure has four upper threads 30 disposed on the front side 22 of the object 20; and one thread body 40 or four thread bodies 40 can be fixed by the seam sections 32 of the upper threads 30.

FIGS. 11A to 15A illustrate that multiple thread bodies 40 are fixed by the seam sections 32 of multiple upper threads 30. In implementation, one thread body 40 can be fixed by one of upper threads 30. In addition, every thread body 40 can be fixed by the non-adjacent seam sections 32 as shown in FIG. 8. Every upper thread 30 can be used to fixed multiple thread bodies 40 as shown in FIG. 9. Every upper thread 30 and the thread body 40 or the thread bodies 40 fixed by the upper thread 30 form the composite sewing thread 50.

Through the invention, the upper thread 30 sewn on the front side 22 of the object 20 can be used to fix the specific thread body (such as a light-reflective yarn) 40 on a surface of various articles, and the specific thread body 40 does not pass through the article, an integrity of its structure and functions can be maintained without detracting from its functionality. The composite sewing thread 50 formed by the upper thread 30 and the thread body 40 of the invention can be used as a sewing thread for clothing, trouser, hat; a sewing thread for leather goods; a sewing thread for school bag, backpack, briefcase, handbag and other bags; a sewing thread for footwear. The composite sewing thread 50 can also be used as an embroidery thread, which can be embroidered on a surface of an article, so that the specific thread body 40 is fixed on a front side of the article by the sewing thread 30. People can see the complete thread body 40 from the front side of the article, such as the thread body 40 with metallic luster can be seen. Functions of the thread body 40 can be directly displayed on the front side of the article, for example, a light-reflective function provided by a light-reflective yarn to clothing; a luminescent function provided by a luminescent yarn to clothing.

Taking the thread body 40 as a light-reflective yarn as an example, structural features of the invention lie in sewing the light-reflective yarn on a surface of a garment, and the light-reflective yarn does not need to penetrate through a fabric of the garment, so micro-glass beads on a surface of the light-reflective yarn can be maintained intact without detracting from a light-reflective function of the light-reflective yarn, thereby clothes sewn with the light-reflective yarn will not have defective products, and a manufacturing yield can be improved.

When the invention is used, the light-reflective yarn can be sewn on the object, because the light-reflective yarn does not need to pass through the object (fabric), the bare light-reflective yarn can be directly used, and the light-reflective yarn does not need to be twisted with other yarns or threads into a yarn with multiple strands. Compared with the prior art, the invention enables the bare light-reflective yarn to be used directly, in addition to be capable of reducing manufacturing costs and time of the light-reflective yarn, a thread diameter of the light-reflective yarn will not be increased owe to directly using the bare light-reflective yarn.

The above-mentioned embodiments are merely used to illustrate the technical ideas and features of the invention, with an object to enable any person having ordinary skill in the art to understand the technical content of the invention and implement it accordingly, the embodiments are not intended to limit the claims of the invention, and all other equivalent changes and modifications completed based on the technical means disclosed in the invention should be included in the claims covered by the invention.

What is claimed is:

1. A thread body sewing structure comprising:

a sheet-shaped object with a front side and a bottom side located on a side opposite to the front side;

at least one upper thread sewn on the sheet-shaped object along a sewing direction and located on the front side of the sheet-shaped object;

at least one lower thread disposed on the bottom side of the object, the lower thread and the upper thread are connected with each other; and at least one thread body disposed on the front side of the sheet-shaped object and disposed along the sewing direction of the upper thread, and the thread body being fixed on the front side of the sheet-shaped object by the upper thread without passing through the sheet-shaped object;

wherein the thread body is a light-reflective yarn, a luminescent yarn, a thread body with metallic luster, or a thread body with conductivity.

2. The thread body sewing structure as claimed in claim 1, wherein the upper thread forms a plurality of seam sections on the front side of the sheet-shaped object along the sewing direction of the upper thread, two ends of each of the seam sections are arranged along the sewing direction, and the thread body is pressed by the seam sections of the upper thread.

3. The thread body sewing structure as claimed in claim 2, wherein each of the thread bodies is fixed by one of the upper threads, and the thread body passes the upper thread from two sides of the upper thread alternately.

4. The thread body sewing structure as claimed in claim 2, wherein each of the thread bodies is fixed by one of the upper threads, and the thread body passes the seam sections of the upper thread in sequence.

5. The thread body sewing structure as claimed in claim 2, wherein each of the thread bodies is fixed by one of the upper threads, and the thread body passes the non-adjacent seam sections of the upper thread and fixed by the non-adjacent seam sections.

6. The thread body sewing structure as claimed in claim 5, wherein at least one of the seam sections that does not press the thread body is disposed between two said seam sections that fix the thread body.

7. The thread body sewing structure as claimed in claim 2, wherein each the upper thread and the thread body fixed by the upper thread form a composite sewing thread, and the composite sewing thread is capable of embroidering patterns on the sheet-shaped object.

8. The thread body sewing structure as claimed in claim 1, comprising a plurality of thread bodies fixed by at least one the upper thread.

9. The thread body sewing structure as claimed in claim 8, wherein the upper thread forms a plurality of seam sections on the front side of the sheet-shaped object, and the thread bodies are pressed by the seam sections of the upper thread.

10. The thread body sewing structure as claimed in claim 9, comprising two thread bodies symmetrically disposed on two sides of the upper thread.

11. The thread body sewing structure as claimed in claim 8, comprising two thread bodies symmetrically disposed on two sides of the upper thread.

12. The thread body sewing structure as claimed in claim 1, wherein each of the thread bodies is fixed by one of the upper threads, and the thread body passes the upper thread from two sides of the upper thread alternately.

13. The thread body sewing structure as claimed in claim 1, wherein each the upper thread and the thread body fixed by the upper thread form a composite sewing thread, and the composite sewing thread is capable of embroidering patterns on the sheet-shaped object.

14. The thread body sewing structure as claimed in claim 1, wherein the front side of the sheet-shaped object has a plurality of upper threads, and one thread body or a plurality of thread bodies.

15. The thread body sewing structure as claimed in claim 2, wherein the front side of the sheet-shaped object has a plurality of upper threads, and one thread body or a plurality of thread bodies.

16. The thread body sewing structure as claimed in claim 1, wherein the sewing direction of the upper thread is straight direction, arc direction, polygonal direction or zig-zag direction, and the thread body is disposed along the sewing direction of the upper thread.

* * * * *